US005173081A

United States Patent [19]

Greig

[11] Patent Number: 5,173,081

[45] Date of Patent: Dec. 22, 1992

[54] SECURITY/PROTECTION FEATURE BUSINESS FORM WITH REPOSITIONAL ADHESIVE

[75] Inventor: Walter G. Greig, Lewiston, N.Y.

[73] Assignee: Moore Business Forms, Inc., Grand Island, N.Y.

[21] Appl. No.: 817,363

[22] Filed: Jan. 6, 1992

[51] Int. Cl.[5] ..... B42D 15/00

[52] U.S. Cl. ..... 462/6; 462/19; 462/900; 428/42; 283/61

[58] Field of Search ..... 462/2, 3, 6, 7, 19, 462/25, 26, 55, 58, 61, 900, 901; 428/40, 41, 42; 283/61

[56] References Cited

U.S. PATENT DOCUMENTS

| | | | |
|---|---|---|---|
| 3,163,447 | 12/1964 | Seekins | 462/25 |
| 4,021,060 | 5/1977 | Seeley et al. | 282/28 R |
| 4,248,919 | 2/1981 | Davis | 462/17 |
| 4,343,492 | 8/1982 | Fitzgibbons | 282/11.5 R |
| 4,583,765 | 4/1986 | Messinger . | |
| 4,814,216 | 3/1989 | Brunett et al. | 462/26 X |
| 4,830,406 | 5/1989 | Instance | 283/81 |
| 4,833,122 | 5/1989 | Doll et al. | 503/226 |
| 4,854,610 | 8/1989 | Kwiatek | 282/11.5 A |
| 4,928,874 | 5/1990 | Henry et al. | 229/74 |
| 4,932,681 | 6/1990 | Wörndli | 462/6 X |
| 4,932,684 | 6/1990 | Vermeulen | 283/81 |
| 5,088,961 | 2/1992 | Sprain | 462/2 |

*Primary Examiner*—Timothy V. Eley
*Assistant Examiner*—Willmon Fridie, Jr.
*Attorney, Agent, or Firm*—Nixon & Vanderhye

[57] ABSTRACT

A business form which allows indicia on a paper sheet to be protected, and provides a removable security covering too, is constructed from an intemediate. The intermediate includes a first paper sheet having a quadrate configuration including two longitudinal edges, and a face and back, and a fold line at a central portion, dividing the sheet into first and second portions. A pattern of repositional adhesive is disposed on the sheet face first portion, and indicia is disposed on the sheet face second portion. A transparent plastic film having a face and back and dimensions about the same as those of the first sheet first portion is disposed over the sheet face first portion and is removably attached to it by the repositional adhesive. Permanent adhesive is disposed on the plastic film back. A second sheet having a release material face and dimensions about the same as the first sheet first portion is disposed in removable contact with the permanent adhesive. The business form is constructed by removing the second sheet from the permanent adhesive and folding the second portion of the first sheet into contact with the permanent adhesive; and ultimately removing the first sheet first portion from the plastic film. The business form may be produced, in part, in continuous format on a press.

20 Claims, 2 Drawing Sheets

Fig. 1
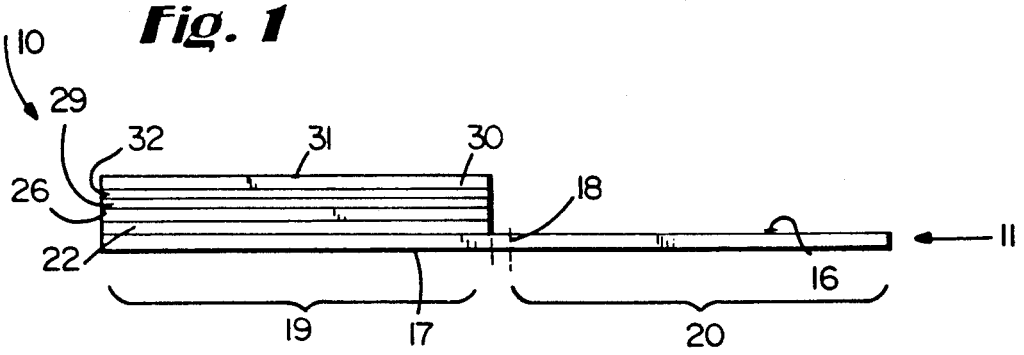
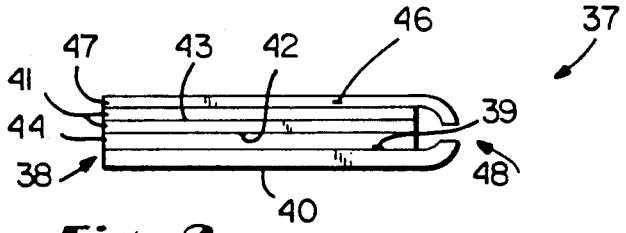
Fig. 2
Fig. 3
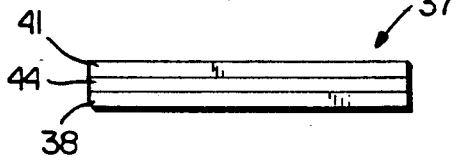
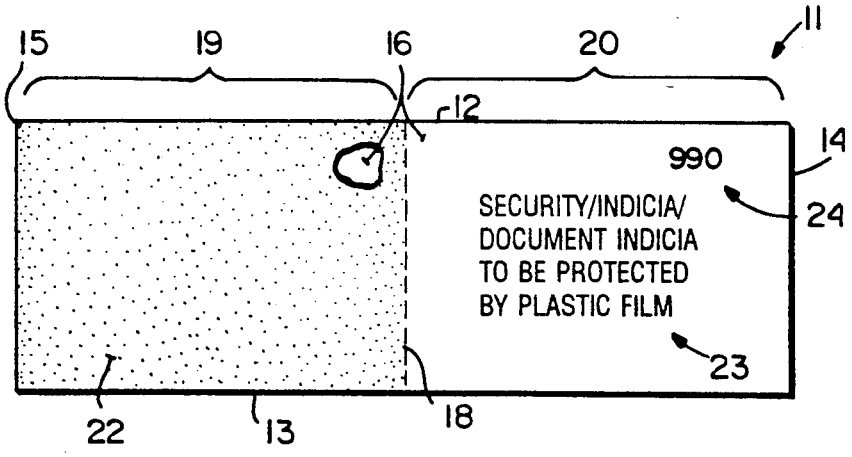
Fig. 4
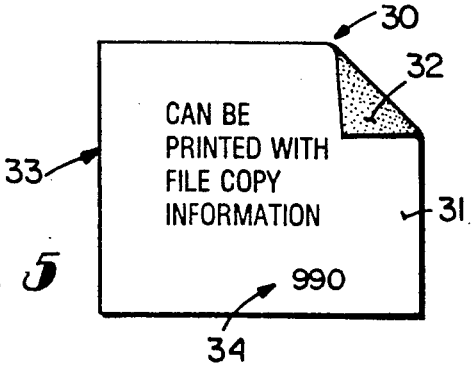
Fig. 5

Fig. 6
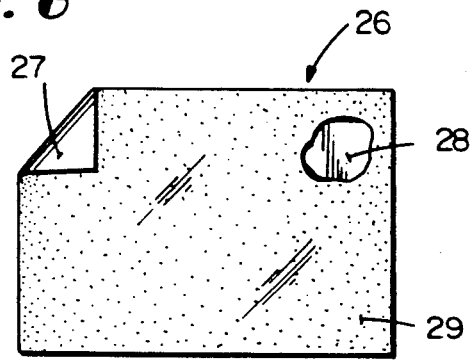
Fig. 7
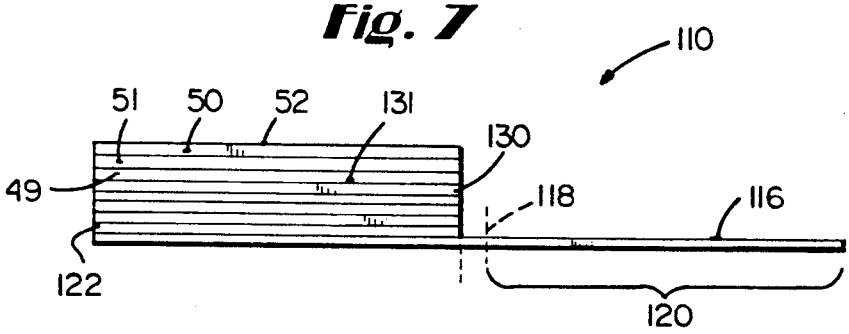
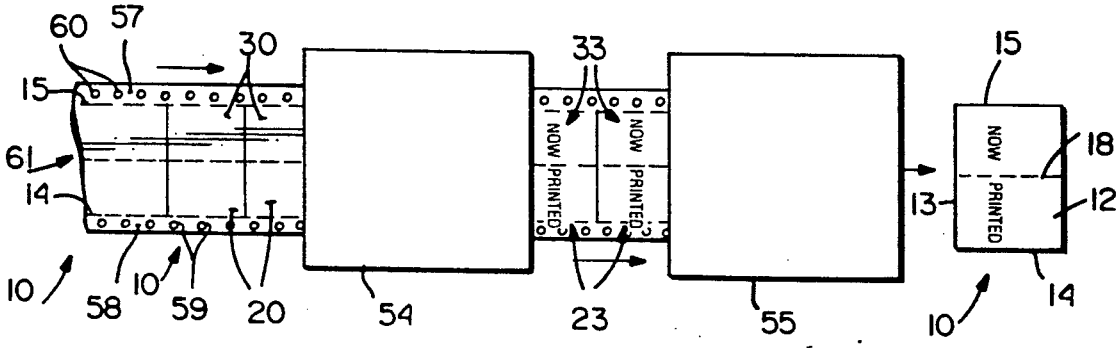
Fig. 8

SECURITY/PROTECTION FEATURE BUSINESS FORM WITH REPOSITIONAL ADHESIVE

BACKGROUND AND SUMMARY OF THE INVENTION

There are many circumstances—such as in the production of identification cards, passes, and the like, where it is desirable to provide a business form comprising a clear film laminated onto a paper sheet containing indicia. The clear film provides protection for the underlying indicia so that it does not smudge, and so that the life of the form is extended. Also the film provides security, protecting against tearing, and may be utilized with other components to protect the confidentiality of what is on the business form. If one attempts to remove the film to alter the underlying indicia, tampering is evident.

According to the present invention, an intermediate for a business form, a business form, and a method of constructing a business form, are provided, in the field of business forms with clear films, which are particularly advantageous. In the construction of the business form according to the present invention, the information on the business form remains confidential until a cover sheet is removed. The cover sheet may be reapplied after removal. Also in the production of the business form according to the invention the protective transparent film is securely and irremovably fastened in the form, i.e. so that it cannot be removed, once applied, without causing damage. The form is also simple to use and construct, being readily manufactured utilizing conventional equipment.

According to a first aspect of the present invention, a business form intermediate is provided. The business form intermediate comprises the following elements. A first paper sheet having a quadrate configuration including two longitudinal edges and two end edges, and a face and back. Means defining a fold line at a central portion of the first paper sheet, essentially perpendicular to the longitudinal edges, dividing the sheet into first and second portions. A pattern (e.g. strip or full coating) of repositional adhesive disposed on the sheet face first portion. Indicia disposed on the first sheet face second portion. A transparent plastic film having a face and a back and dimensions substantially the same as those of the first sheet first portion, the film face disposed covering the first sheet face first portion and removably attached thereto by the repositional adhesive. Permanent adhesive disposed on the plastic film back. And, a second sheet having a release material face and dimensions substantially the same as the first sheet first portion, the second sheet release material face in removable contact with the permanent adhesive.

Typically the second sheet is a paper sheet with a paper face opposite the release material face, and indicia is disposed on the paper face at least in part corresponding to the indicia on the first sheet second portion face. The fold line typically comprises a line of weakness (such as a perforation). The first sheet first and second portions typically have substantially the same shape and dimension. The repositional adhesive pattern preferably comprises a full coat of repositional adhesive covering essentially the entire face of the first portion of the first sheet. The intermediate may also be in continuous format, connected to a plurality of like sheets, with end edge marginal portions having tractor drive holes.

If desired, one or more additional sheets with image transfer coatings may be applied onto the top of the second sheet. For example a third CB sheet may be provided on top of the second sheet, and the second sheet may be a CF sheet.

The invention also comprises a business form constructed from the intermediate of FIG. 1. The business form is constructed by removing the second sheet from the permanent adhesive, and folding the first sheet second portion about the fold line so that it comes in contact with the permanent adhesive. An exemplary business form according to the present invention thus comprises the following components: A first paper sheet having a face and a back. Indicia provided on the first paper sheet face. A transparent plastic film having substantially the same configuration and length and width dimensions as the first paper sheet, and a face and a back. A second paper sheet having substantially the same configuration and length and width dimensions as the first paper sheet. Repositional adhesive removably connecting the second paper sheet to the transparent film film. And, permanent adhesive connecting the plastic film face to the first paper sheet face so that the plastic film covers the indicia on the first paper sheet face, yet the indicia is readable therethrough. The second paper sheet can be removed from the transparent film so as to expose the indicia (viewed through the film and protected by the film) on the first paper sheet. Whenever it is desired to cover up that indicia, the second paper sheet may be reapplied due to the repositional adhesive thereon.

According to yet another aspect of the present invention a method of constructing a business form, utilizing a printer, is provided. The method comprises the following steps: (a) Applying a pattern of repositional adhesive over the face of the first paper sheet first portion. (b) Applying a transparent plastic film, having a face and a back, so that the face is over and in contact with the repositional adhesive. (c) Applying a permanent adhesive to the back of the plastic film. (d) Applying a second sheet over the transparent film so that the release face is in contact with the permanent adhesive. (e) After steps (a)–(d) passing the first sheet through the printer and imprinting indicia on the first sheet second portion and the second sheet printable face. Then, (f) removing the second sheet from the permanent adhesive. And, (g) folding the first sheet about the fold line and bringing the first sheet second portion into contact with the permanent adhesive so that it is adhered thereto.

The method also preferably comprises the further step (h), after step (g), of detaching the first sheet second portion and repositional adhesive from the transparent film so that the indicia on the first sheet first portion face is readable through the transparent film, and the step (i) after step (h) of reapplying the first sheet second portion to the transparent film face using the repositional adhesive. Step (h) may be further practiced by separating the first and second portions from each other at the fold line.

The first sheet may be in continuous form with like first sheets, in which case step (e) is practiced by moving a plurality of first sheets in continuous form through the printer, and comprising the further step, between steps (e) and (f), of bursting the continuous form to provide individual sheets, or cut sets.

It is the primary object of the present invention to provide an advantageous business form of the type having a paper sheet protected by a clear film. This and other objects of the invention will become clear from an inspection of the detailed description of the invention, and from the appended claims.

BRIEF DESCRIPTION OF THE DRAWINGS

FIG. 1 is a schematic side view, with the relative size of the components greatly enlarged, showing an exemplary business form intermediate according to the invention;

FIG. 2 is a side schematic view of a business form according to the invention constructed from the intermediate of FIG. 1;

FIG. 3 is the business form of FIG. 2 with the cover sheet with repositional adhesive removed;

FIG. 4 is a top plan view of a first paper sheet component of the intermediate of FIG. 1;

FIG. 5 is a top plan view of a second paper sheet of the intermediate of FIG. 1;

FIG. 6 is a bottom plan view of the transparent film (with permanent adhesive coating) component of the intermediate of FIG. 1;

FIG. 7 is a view like that of FIG. 1 only illustrating another embodiment of intermediate; and FIG. 8 is a top schematic view indicating apparatus for practicing a portion of a method of constructing the business form of FIG. 2.

DETAILED DESCRIPTION OF THE DRAWINGS

An exemplary business form intermediate according to the present invention is shown generally by reference numeral 10 in FIG. 1. The intermediate includes a first paper sheet 11 (see FIGS. 1 and 4) typically having a quadrate (e.g. rectangular) configuration with two longitudinal edges 12, 13, and two end edges 14, 15 (FIG. 4). It also includes a face 16 and a back (see FIG. 1) 17. Means are provided defining a fold line 18 at a central portion of the sheet 11, essentially perpendicular to the edges 12, 13, and dividing the sheet 11 into first and second portions on opposite sides of the fold line 18, i.e. the first portion 19 and the second portion 20. The fold line 18 preferably is a line of weakness, such as a perforation. The line 18 typically divides the sheet 11 into essentially two equal sized portions 19, 20.

The intermediate 10 also comprises a pattern—such as a full coating—of repositional adhesive 22 applied to the first portion 19 of the sheet 11. The repositional adhesive 22 is of the type that can be readily removed from one substrate, and placed upon another without marking or destroying the first substrate, such as the type manufactured by Moore Business Forms, Inc. of Lake Forest, Ill. for its NOTESTIX® products, or by 3M of Minneapolis, Minn. for its POST-IT® products. While a full coating of the adhesive 22 is desired, stripes or other patterns may also be utilized.

The intermediate 10 also includes indicia disposed on the first sheet 11 face 16 second portion 20. The indicia is illustrated schematically by reference numerals 23 and 24 in FIG. 4.

Another component of the intermediate 10 is a transparent plastic film 26 (see FIGS. 1 and 6) having a face 27 and a back 28. The dimensions of the transparent film 26 are essentially the same as those of the first portion 19 of the first sheet 11, as is the configuration (e.g. quadrate). The face 27 is disposed covering the face 16 of the first portion 19 of the first sheet 11, and the film 26 is removably held to the sheet 11 by the repositional adhesive 22.

A permanent adhesive 29 (see FIGS. 1 and 6) is provided on the back 28 of the film 26. Once the permanent adhesive 29 moves into contact with a conventional paper sheet it will not release without destroying the sheet. The permanent adhesive 29 may be of any conventional type as long as it is not opaque.

Finally, the intermediate 10 comprises a second sheet 30 (see FIGS. 1 and 5), typically of paper, having a paper face 31 (the top face in FIG. 1), and a release material face 32. That is a conventional release chemical coating 32 is provided on the bottom (as viewed in FIG. 1) face of the paper shield 30. The release material 32 is in contact with the permanent adhesive 29 and may be readily removed therefrom, the adhesive 29 having much less affinity for the release material 32 than for the film 26. The second sheet 30 preferably has the same configuration and dimensions as the film 26, and indicia 33, 34 is normally imprinted on the paper face 31. Note that the indicia 23, 24 on the first sheet 11 second portion 20 and the indicia 33, 34 on the second sheet 30 top face 31 preferably include some like components (e.g. see 24, 34), the sheet 30 being capable of serving as a file or record copy of what is provided on the first sheet second portion 20. If desired, all the indicia 23, 24, 33, 34 on the portion 20 and sheet 30 may be the same (or substantially the same).

FIG. 2 illustrates a business form, shown generally by reference numeral 37, constructed utilizing the intermediate 10. In FIG. 2, as in FIG. 1, the relative sizes of the components are greatly exaggerated in order to illustrate the components. Note that the business form 37 comprises a first paper sheet 38 having a face 39 and a back 40. The sheet 38 corresponds to the second portion 20 of the sheet 11 of the intermediate 10, and indicia (like the indicia 23, 24) is provided on the face 39 of the sheet 38. A transparent plastic film 41 has substantially the same configuration and length and width dimensions as the sheet 38 and a face 42 and a back 43. The film 41 corresponds to the film 26 in the intermediate 10. Permanent adhesive 44 connects the faces 39, 42 of the elements 38, 41 together, the permanent adhesive 44 corresponding to the adhesive 29 in the intermediate 10.

Finally, the business form 37 includes a second, opaque, paper sheet 46 having substantially the same configuration and length and width dimensions as the first sheet 38, and repositional adhesive 47 connects the second, paper sheet 46 to the transparent film 41 back 43. The second sheet 46 corresponds to the first portion 11 of the first sheet 11 of the intermediate 10, while the repositional adhesive 47 corresponds to the repositional adhesive 22 in the intermediate 10.

The business form 37 is constructed from intermediate 10 by removing the sheet 30, with release coating 32, from the adhesive 29, and then folding the second portion 20 about the fold line 18 so that the face 16 thereof comes into contact with the permanent adhesive 29. The portions 19, 20 may be readily detached at the fold line 18, as illustrated schematically generally by reference 48 in FIG. 2.

The business form 37 comprises a paper sheet having indicia thereon protected by a transparent film adhered by permanent adhesive to the paper sheet, the film protecting the indicia on the paper sheet and protecting it from ripping. However as long as the second sheet 46 is on top of the film 41 the indicia is not visible, but rather remains confidential. However by peeling back the second sheet 46 one can readily view the indicia on the surface 39 of the first sheet 38 through the transparent film 41. When it is desired to again cover up the indicia, the user merely reapplies the second sheet 46 to the film 41, the repositional adhesive on the sheet 46 holding it in place. FIG. 3 illustrates the business form 37 with the second sheet 46 and associated repositional adhesive 47 removed.

FIG. 7 illustrates a second embodiment of the intermediate according to the invention. In FIG. 7, structures corresponding to the FIGS. 1, 4, and 6 embodiment are illustrated by the same reference numeral only preceded by a "1".

The only distinction between the intermediate 110 and the intermediate 10 is the provision of the additional paper layer and associated image transfer means. That is the sheet 130 has applied on the upper face 131 thereof a CF coating 49, while a third paper sheet 50 is provided on top of sheet 130, the sheet 50 having a CB coating 51. While CB/CF coatings 49, 51 are illustrated, a self-imaging material may be provided on the surface 131 of the sheet 130, or other image transfer means may be utilized. In any event, when the top surface 52 of the third sheet 50 is imprinted or otherwise impacted, any indicia applied thereto is transferred by the image transfer means 49, 51 to the top surface 131 of the sheet 130.

The invention also contemplates a method of constructing the business form 37. Apparatus for practicing a part of the method is illustrated schematically in FIG. 8, in which a printer 54 and a burster 55 are depicted in schematic association with a number of business form intermediates 10 shown in continuous form, including having end edge marginal portions 57, 58 with tractor drive holes 59, 60 therein connected by perforations to the end edges 14, 15 of each intermediate 10.

The continuous web of intermediates 10 is shown generally by reference numeral 61 in FIG. 8, and in the practice of the method of the invention it is preferably passed to a conventional printer 54. The indicia 33, 23 is applied by the printer 54, and then in the conventional burster/separator 55 the individual intermediates 10 are detached from each other along their longitudinal edges 12, 13, and the marginal portions 57, 58 are separated from the end edges 14, 15. The business form 37 is then further constructed by removing the sheet 30 with release coating 32, and bending the portion 20 about the fold line 18, as described above.

The business form and intermediate according to the present invention are advantageous in that until the sheet 46 with repositional adhesive 47 thereon is removed from covering the plastic film 41, the indicia 23, 24 on the protected paper sheet 38 is concealed. When the sheet 46 is removed it can be readily reapplied, with the conventional adhesive. Also the plastic film 41 is securely fastened to the form 37 by the permanent adhesive 44, so that the film 41 cannot be removed once it is applied without causing damage. The construction of the form 37 from the intermediate 10 is extraordinarily simple, merely requiring the removal of the top sheet 30 with its release coating 32 from the permanent adhesive 29, and then folding the paper portion 20 about the fold line 18 into place in association with the adhesive 29.

If one attempts to remove the film 44 and access the indicia (for example to change it), tampering is readily visible.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent forms and processes.

What is claimed is:

1. A business form intermediate comprising:

a first paper sheet having a quadrate configuration including two longitudinal edges and two end edges, and a face and back;

means defining a fold line at a central portion of said first paper sheet, essentially perpendicular to said longitudinal edges, dividing said sheet into first and second portions;

a pattern of repositional adhesive disposed on said sheet face first portion;

indicia disposed on said first sheet face second portion;

a transparent plastic film having a face and a back and dimensions substantially the same as those of said first sheet first portion, said film face disposed covering said first sheet face first portion and removably attached thereto by said repositional adhesive;

permanent adhesive disposed on said plastic film back; and a second sheet having a release material face and dimensions substantially the same as said first sheet first portion, said second sheet release material face in removable contact with said permanent adhesive.

2. A business form intermediate as recited in claim 1 wherein said second sheet is a paper sheet and has a paper face opposite said release material face, and indicia disposed on said paper face at least in part corresponding to said indicia on said first sheet second portion face.

3. A business form intermediate as recited in claim 2 wherein said fold line comprises a line of weakness.

4. A business form intermediate as recited in claim 3 further comprising at least a third sheet having substantially the same dimensions as said first sheet first portion and disposed over said second sheet paper face, and image transfer means provided between said third sheet and said second sheet paper face for transferring an image imprinted on said third sheet to said second sheet paper face.

5. A business form intermediate as recited in claim 2 further comprising at least a third sheet having substantially the same dimensions as said first sheet first portion and disposed over said second sheet paper face, and image transfer means provided between said third sheet and said second sheet paper face for transferring an image imprinted on said third sheet to said second sheet paper face.

6. A business form intermediate as recited in claim 1 wherein said second sheet is a paper sheet and has a paper face opposite said release material face; and further comprising at least a third sheet having substantially the same dimensions as said first sheet first portion and disposed over said second sheet paper face, and image transfer means provided between said third sheet and said second sheet for transferring an image imprinted on said third sheet to said second sheet paper face.

7. A business form intermediate as recited in claim 1 wherein said first sheet first and second portions have substantially the same shape and dimensions.

8. A business form intermediate as recited in claim 1 wherein said first sheet is in continuous format, connected to a plurality of like sheets, with end edge marginal portions having tractor drive holes therein.

9. A business form intermediate as recited in claim 1 wherein said repositional adhesive pattern comprises a coating of repositional adhesive covering essentially the entire face of said first portion of said first sheet.

10. A business form intermediate as recited in claim 1 wherein said fold line comprises a line of weakness.

11. A business form intermediate as recited in claim 10 wherein said first sheet first and second portions have substantially the same shape and dimensions.

12. A business form intermediate as recited in claim 11 wherein said repositional adhesive pattern comprises a coating of repositional adhesive covering essentially the entire face of said first portion of said first sheet.

13. A business form intermediate as recited in claim 12 wherein said first sheet is in continuous format, connected to a plurality of like sheets, with end edge marginal portions having tractor drive holes therein.

14. A business form comprising:

a first paper sheet having a face and a back;

indicia provided on said first paper sheet face;

a transparent plastic film having substantially the same configuration and length and width dimensions as said first paper sheet, and a face and a back;

a second paper sheet having substantially the same configuration and length and width dimensions as said first paper sheet;

repositional adhesive removably connecting said second paper sheet to said transparent film, and permanent adhesive connecting said plastic film face to said first paper sheet face so that said plastic film covers the indicia on said first paper sheet face, yet the indicia is readable therethrough.

15. A method of constructing a business form, utilizing: a first paper sheet having a face and a back, and first and second portions separated by a fold line; a second sheet having a release face and a printable face; and a printer; comprising the steps of:

(a) applying a pattern of repositional adhesive over the face of the first paper sheet first portion;

(b) applying a transparent plastic film, having a face and a back, so that the face is over and in contact with the repositional adhesive;

(c) applying a permanent adhesive to the back of the plastic film;

(d) applying a second sheet over the transparent film so that the release face is in contact with the permanent adhesive;

(e) after steps (a)-(d) passing the first sheet through the printer and imprinting indicia on the first sheet second portion and the second sheet printable face; then (f) removing the second sheet from the permanent adhesive; and (g) folding the first sheet about the fold line and bringing the first sheet second portion into contact with the permanent adhesive so that it is adhered thereto.

16. A method as recited in claim 15 comprising the further step (h), after step (g), of detaching the first sheet second portion and repositional adhesive from the transparent film so that the indicia on the first sheet first portion face is readable through the transparent plastic film.

17. A method as recited in claim 16 comprising the further step (i), after step (h), of reapplying the first sheet second portion to the transparent film face using the repositional adhesive.

18. A method as recited in claim 16 wherein step (h) is further practiced by separating the first and second portions from each other at the fold line.

19. A method as recited in claim 15 wherein the first sheet is in continuous form with like first sheets, and wherein step (e) is practiced by moving a plurality of first sheets in continuous form through the printer, and comprising the further step, between steps (e) and (f), of bursting the continuous form to provide individual sheets.

20. A method as recited in claim 15 further utilizing a third sheet over the second sheet, with imaging means between he second and third sheets; and wherein step (e) is practiced by impacting the third sheet so that printing applied thereto is transferred to the second sheet printable face.

* * * * *